US005136737A

United States Patent [19]

Reppas et al.

[11] Patent Number: 5,136,737

[45] Date of Patent: Aug. 11, 1992

[54] SELF STANDING CONVERTIBLE FURNITURE FRAME ASSEMBLY

[75] Inventors: George S. Reppas, 1030 San Raymundo Rd., Hillsborough, Calif. 94010; Thomas M. Sherlock, Los Altos Hills; Jeffery K. Sullivan, San Jose, both of Calif.

[73] Assignee: George S. Reppas, San Francisco, Calif.

[21] Appl. No.: 593,665

[22] Filed: Oct. 5, 1990

[51] Int. Cl.[5] ..... A47C 17/52

[52] U.S. Cl. ..... 5/2.1; 5/136; 5/162; 5/164.1; 5/167

[58] Field of Search ..... 5/2.1, 133, 136, 159.1, 5/162, 163, 164.1, 167, 168

[56] References Cited

U.S. PATENT DOCUMENTS

| | | | |
|---|---|---|---|
| 209,604 | 11/1878 | Blackman | 5/164.1 |
| 212,348 | 2/1879 | Blackman | 5/164.1 |
| 566,813 | 9/1896 | Swaney | 5/168 X |
| 2,650,370 | 9/1953 | Cudini | 5/136 X |
| 2,652,572 | 9/1953 | Hopeman, Jr. et al. | 5/9.1 |
| 2,741,779 | 4/1956 | Hopeman, Jr. et al. | 5/167 X |
| 3,179,956 | 4/1965 | Bennett | 5/136 |
| 3,464,070 | 9/1969 | Driver | 5/164.1 X |
| 3,597,568 | 7/1976 | Drexhage | 5/164.1 X |
| 4,070,715 | 1/1978 | Reppas . | |
| 4,318,195 | 3/1982 | Reppas . | |
| 4,476,592 | 10/1984 | Reppas et al. . | |
| 4,597,568 | 7/1986 | Drexhage . | |
| 4,885,813 | 12/1989 | McNamara | 5/136 |

*Primary Examiner*—Michael F. Trettel
*Attorney, Agent, or Firm*—Harness, Dickey & Pierce

[57] ABSTRACT

A convertible furniture frame assembly having a stationary base assembly that supports at least one retractable supporting means. This supporting means is used to support retractable furniture components as they are raised and lowered. The invention further incorporates at least one generally horizontal self standing support means to stabilize the furniture frame assembly and at least one two-bar torsion system that aids users in raising and lowering the furniture components. The user is also aided by a self-energizing latching means that automatically latches the retractable supporting means in its lowered position. The user is further convenienced by a retaining means that prevents loose articles on the furniture components from sliding into the base assembly during retraction.

53 Claims, 7 Drawing Sheets

SELF STANDING CONVERTIBLE FURNITURE FRAME ASSEMBLY

BACKGROUND AND SUMMARY OF THE INVENTION

The present invention relates generally to the raising and lowering of convertible furniture and more particularly to convertible furniture with: an improved torsion bar system that mechanically aids in the raising of furniture components, a self-standing support means that stabilizes the furniture without attaching to a separate structure, a self-energizing latching means that automatically latches the furniture in a lowered position, and a retaining means for retaining articles left on the furniture components during retraction.

The present invention is well suited for convertible furniture that is heavy and exerts large loads as it retracts into position such as that disclosed in U.S. Pat. Nos. 4,070,715, 4,318,195 and 4,476,592. The individual features of this invention aid a user in overcoming the problems associated with these large loads. One such feature is an improved torsion system that utilizes two cantilevered bars and an adjustable clamping means. This configuration permits more potential energy to be stored at a reduced torsional stress. Torsion systems have been previously utilized with convertible furniture, but those configurations utilized single bars that individually extended from one end of the base assembly to the other. A typical example of this configuration is demonstrated in U.S. Pat. No. 4,597,568 (Drexhage).

In general, torsion systems are used with convertible furniture to store potential energy as the furniture components are lowered. The amount of potential energy stored in a torsion bar is a function of torsional stress. Torsional stress is defined by the amount of twist per unit length of the bar. Since the length of previously used torsion bars has been limited to the width of the base assembly, a need has been recognized for a torsion bar system that increases torsion bar length without increasing the size of the base assembly. This would allow potential energy to be stored with a decreased amount of twist per unit length. Accordingly, the present invention provides a cantilevered torsion bar system that can potentially double the effective length of a conventional torsion bar within a conventional base assembly.

When convertible furniture utilizes a torsion bar system, energy stored in each bar places tremendous moments on the stationary base assembly. With previously known convertible furniture, it has been necessary to fixedly attach the base assembly to a support structure; typically, the support structure used is a floor or a wall. By fixedly attaching the base assembly to a rigid structure, the energy stored in each bar is held in check. Thus, the torsion bars are not permitted to recoil and flip the base assembly from its footing. Unfortunately, once this type of convertible furniture is installed, it is very difficult to move, and if it is moved, mounting holes in the structure and its covering remain. Alternatively, a very large base assembly has been utilized to support and stabilize convertible furniture without having to be attached to a wall or floor. However, this type of base assembly required a large structure which enclosed much of the furniture components.

Thus, a need has been recognized for a self-standing support means that requires minimal base assembly structure to stabilize convertible furniture. Accordingly the present invention incorporates at least one generally horizontal out rigger. This eliminates the need to fasten the base assembly to a floor or wall structure.

Another feature of this invention is its utilization of a self-energizing latching means to automatically latch the furniture in place when fully lowered. This latching means permits the user to simply lower the convertible furniture into position without manually actuating a latch.

Yet another feature of this invention is the incorporation of a retaining means for retaining articles left on the furniture components. This retaining means prevents articles left on the furniture components from sliding off the component and into the base assembly during retraction. As a result, articles inadvertently left on the components are not lost within the base assembly, and articles purposely placed on the components are held in place.

Additional advantages and features of the present invention will become apparent from the subsequent description and the claims taken in conjunction with the accompanying drawings.

DESCRIPTION OF THE PREFERRED EMBODIMENT

Figure 1:
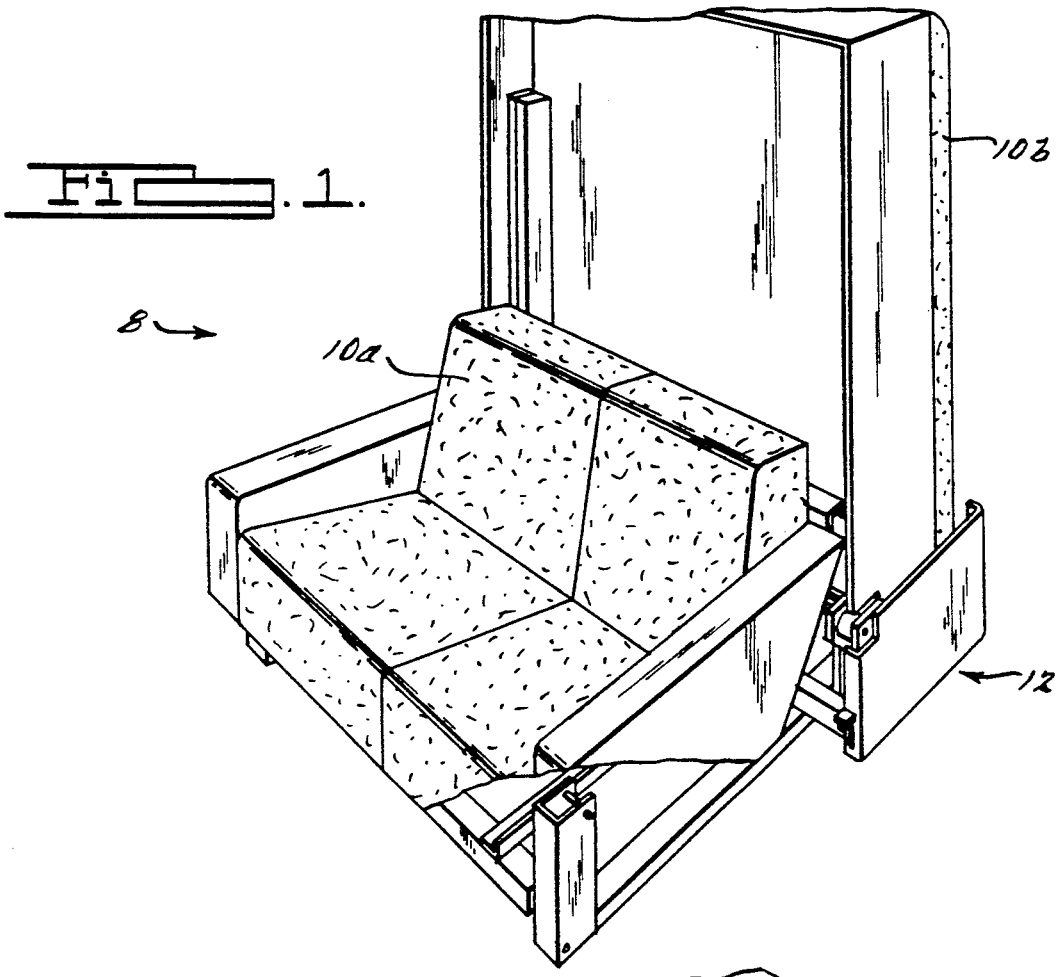
FIG. 1 is a perspective view showing a combination bed/sofa piece of convertible furniture in the raised position with a portion of the sofa broken away to show the frame assembly.
Figure 2:
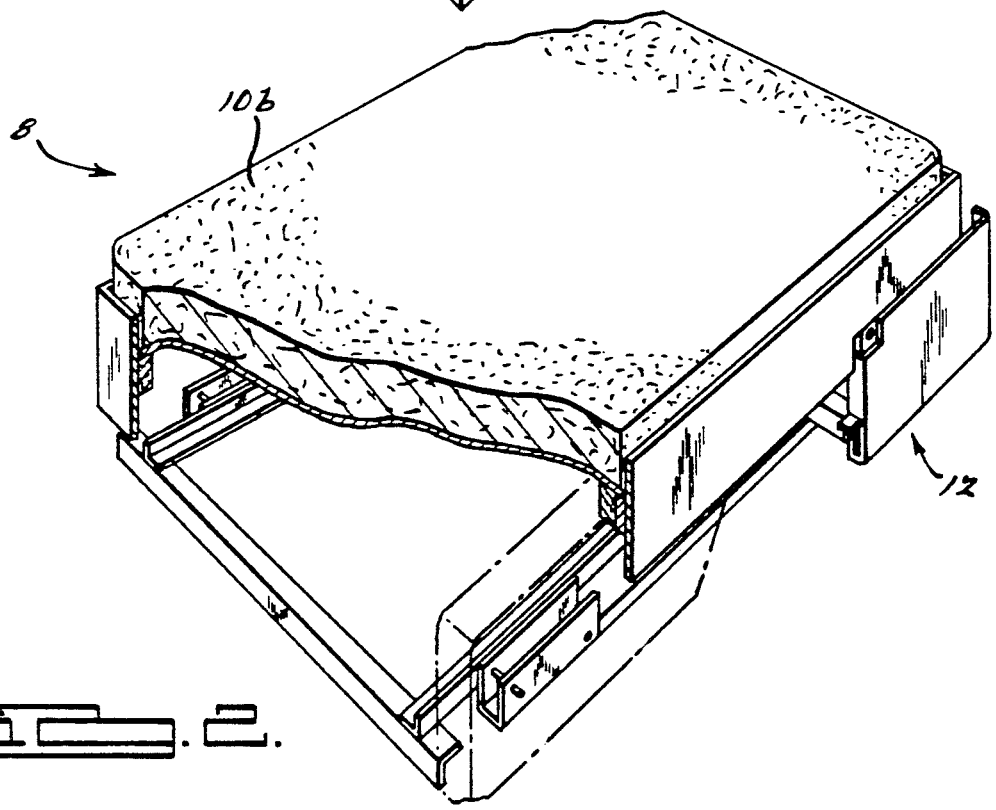
FIG. 2 is a perspective view showing a combination bed/sofa piece of convertible furniture in the lowered position with a portion of the bed broken away to show the frame assembly.

Referring now to the drawings and in particular to FIGS. 1 and 2, a combination sofa/bed convertible furniture frame assembly 8 is shown in both raised and lowered positions. Although this particular combination is the only embodiment depicted in the drawings, the features of the invention can be utilized on other combinations such as a table/desk, a bed/desk, etc. and on individual pieces such as a retractable table, a retractable bed, etc. Moreover, the features of this invention can be used individually or in any combination. The use of this particular embodiment is for exemplary purposes only.

Figure 3:
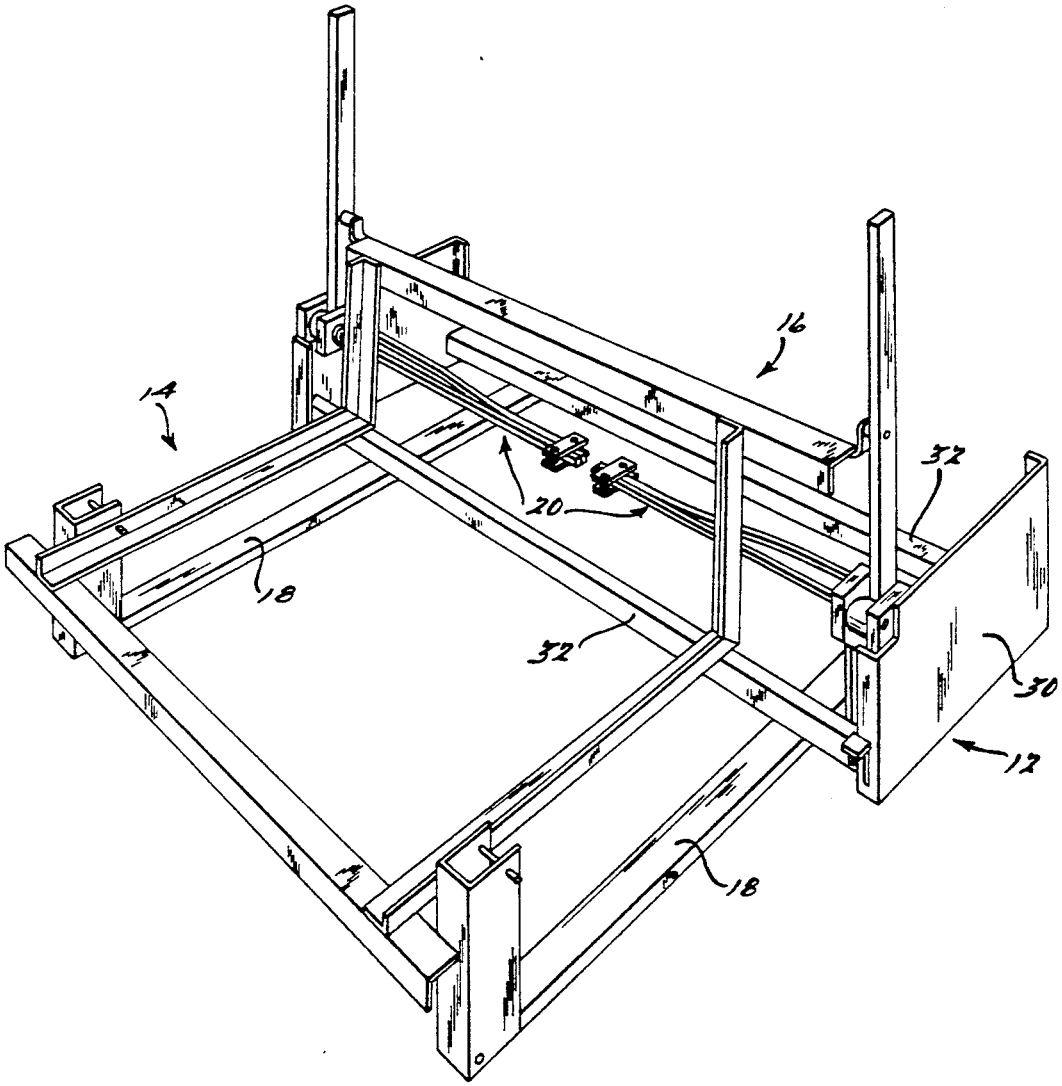
FIG. 3 is a perspective view showing a combination bed/sofa convertible furniture frame in the raised position.
Figure 4:
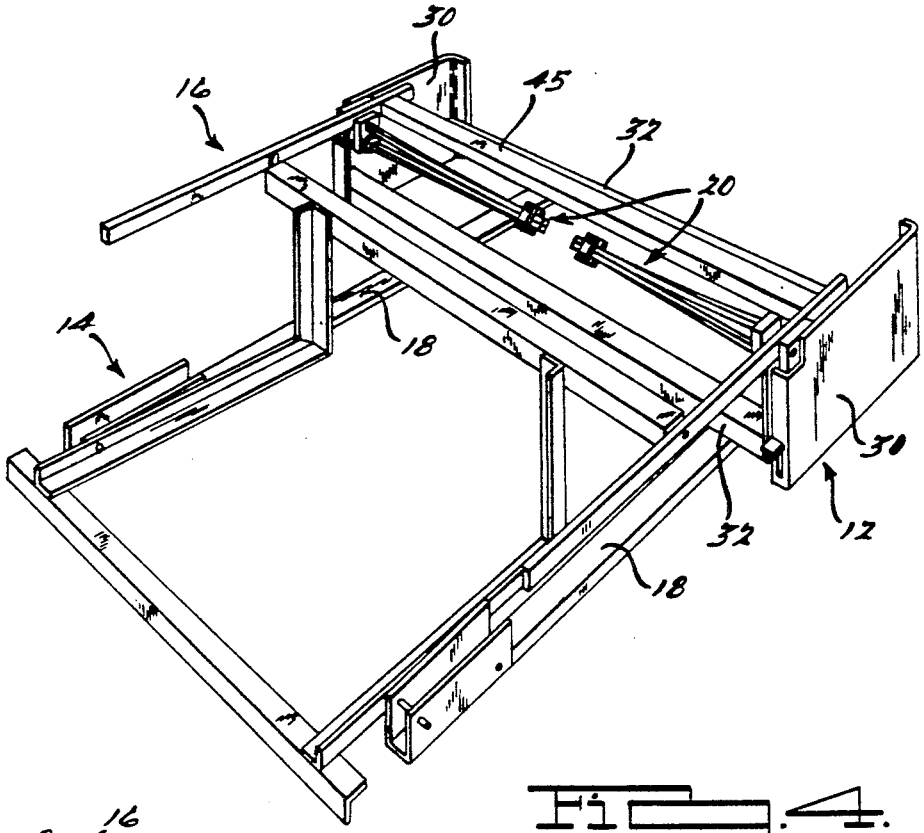
FIG. 4 is a perspective view showing a combination bed/sofa convertible furniture frame in the lowered position.

Referring now to FIGS. 3 and 4, a base assembly is shown to support two retractable supporting means 14 and 16. These supporting means 14 and 16 support both sofa and bed components 10(*a*) and 10(*b*) respectively. This embodiment also incorporates two generally horizontal self-standing support means 18 fixedly attached to the base assembly 12. FIGS. 3 and 4 further depict two-bar torsion systems 20 that store potential energy as the retractable support means 14 and 16 are lowered. The invention also incorporates a self-energizing latching means 28, as shown in FIGS. 7–12, and a retaining means for retaining articles left on the furniture components, as shown in FIGS. 13–16. This and other features of the present invention will be further described in greater detail hereafter.

A base assembly 12 is generally comprised of two end plates 30 and two beams 32 that traverse laterally from one end plate 30 to the other. This base assembly 12 provides a stationary frame upon which the features of this invention are employed. For example, the retractable supporting means 14 and 16 are pivotably attached to the end plates 30; both the torsion systems 20 and the latching means 28 are integrally connected to the end plates 30; and the self-standing support means 18 are fixedly attached to the lateral beams 32. As shown in FIGS. 1 through 4, these self-standing support means 18 require minimal base assembly structure to be effective. This eliminates the need for a large base assembly that encloses portions of the furniture components 10(*a*) and 10(*b*).

The retractable supporting means 14 and 16, shown in FIGS. 3 and 4, are primarily comprised of members that pivotably attach to both the base assembly 12 and to one another. These members support furniture components 10(*a*) and 10(*b*) such that when a particular retractable supporting means is in its upright position, the furniture components 10(*a*) and 10(*b*) take the shape of a particular piece of furniture (see FIGS. 1 and 2). In this embodiment, the retractable supporting means 14 supports furniture components 10*a* that take the shape of a sofa, and the retractable supporting means 16 supports furniture components 10*b* that take the shape of a bed.

To assist a user of convertible furniture in raising and lowering furniture components !0, a novel two-bar torsion system 20 may be used. The embodiment shown in FIGS. 5 and 6 utilizes two two-bar torsion systems 20 that store potential energy as the components 10(*a*) and 10(*b*) are lowered; two systems 20 are utilized to balance the loads on the base assembly 12. Each of these torsion systems 20 is comprised of a first bar 22 that is fixedly attached to a portion of the retractable supporting means 16. The first bar 22 cantilevers laterally within the base assembly 12 from a portion of the retractable supporting means 16. A second bar 24 is fixedly attached to the end plate 30 and cantilevers therefrom generally parallel and adjacent to the first bar 22. Cantilevered portions of the bars 22 and 24 are fixedly attached to one another by an adjustable clamping means 26. Accordingly, as the retractable supporting means 16 is lowered, the bars 22 and 24 twist in unison and consequently both store potential energy.

The amount of potential energy stored in a torsion bar is a function of torsional stress. Torsional stress is related to the amount of twist per unit length of the bar. Since approximately 90 degrees of rotation is required to lower most convertible furniture pieces, the amount of twist in most convertible furniture torsion systems is approximately 90 degrees. As a result the only way to increase or decrease the amount of twist per unit length is to increase or decrease the length of the torsion bar. Accordingly, the cantilevered two-bar torsion system described herein decreases the amount of twist per unit length by twisting along the length of both bars.

Figure 5:
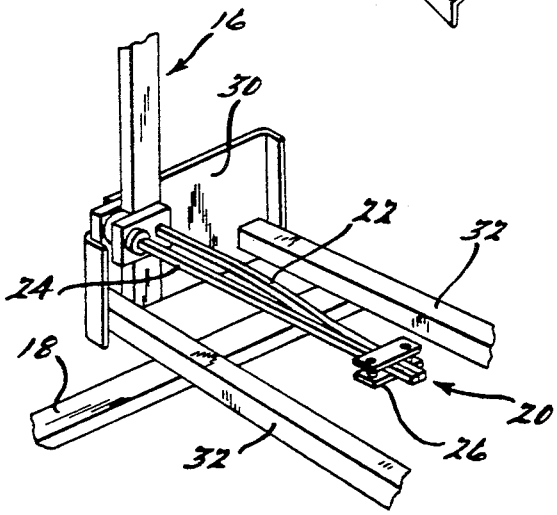
FIG. 5 is a perspective view showing the two-bar torsion system and the self-standing support means with the frame in a raised position.
Figure 6:
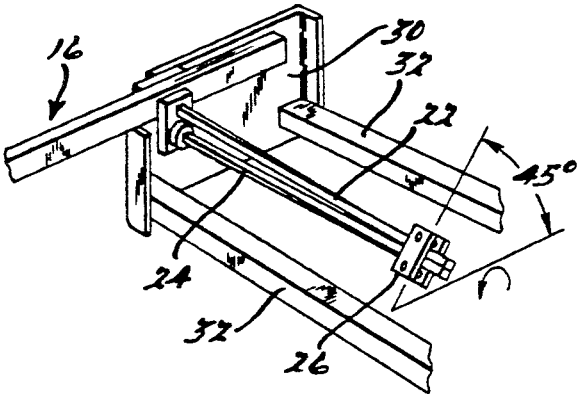
FIG. 6 is a perspective view showing the two-bar torsion system and the self-standing support means with the frame in a lowered position.

To adjust the amount of potential energy stored in these bars, a user may vary the effective length of the bars. Bar length adjustment can be easily accomplished with the present invention by a clamping means that slidingly engages with both bars 22 and 24. As shown in FIGS. 5 and 6, the clamping means utilized 26 is capable of clamping to adjacent cantilevered portions of the bars 22 and 24. Once the clamping means 26 is fixedly attached, the length of bar capable of twisting is limited to those portions that span between the clamping means 26 and their fixed ends.

For example, if the clamping means 26 is clamped to the distal end of the bars 22 and 24, the full length of both bars would be capable of twisting. Thus, as the retractable supporting means 16 is lowered approximately 90 degrees, the full length of both torsion bars are twisted approximately 45 degrees each. Since the entire length of both bars are allowed to twist, the torsional stress generated is distributed over their entire lengths. As a result, the amount of twist per unit length is reduced and the corresponding torsional stress is reduced. In turn, this diminishes the possibility of torsion bar failure.

As the clamping means 26 is slid closer to the bar's fixed ends, the effective length of the bars 22 and 24—that portion capable of twisting—is shortened. Thus, twist per unit length increases, thereby increasing the torsional stress generated and the potential energy stored. Accordingly, if heavier furniture components 10 are utilized, the clamping means can be adjusted to shorten the effective length of the bars 22 and 24. This will cause more potential energy to be stored in the bars 22 and 24, and will consequently aid the user in retracting heavier furniture components 10.

Figure 7:
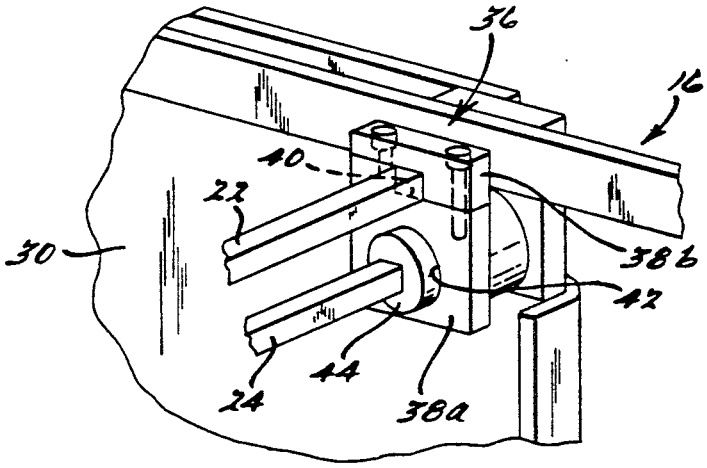
FIG. 7 is a perspective view showing the torsion bar locking assembly.

The embodiment shown in FIG. 7 depicts a two-bar torsion system locking means 36 for rigidly attaching the first torsion bar 22 to the retractable supporting means 16. The locking means 36 also pivotably couples the retractable supporting means 16 to the second bar 24. This locking means 36 is comprised of a pair of L-shaped members 38(*a*) and 38(*b*). One of the L-shaped members 38(*a*) is rigidly attached to the retractable supporting means 16 while the other L-shaped member 38(*b*) is bolted on top of the first L-shaped member 38(*a*). The L-shaped members 38(*a*) and 38(*b*) are configured such that a rectangular trap 40 is created to lock one end of the first torsion bar 22.

The fixed L-shaped member 38(*a*) further provides a bore 42 that allows the second bar 24 to pass through and rigidly attach to the end plate 30. By providing a bore 42 for the second bar 24 to pass through, the locking means 36 simultaneously acts as a pivoting means. This allows the retractable supporting means 16 to pivot about an axis in close proximity to the torsional axis of both bars 22 and 24. Note that this bore 42 passes through a portion of the fixed L-shaped member 38(*a*) that extends below the supporting means 16. Also note that a bushing 44 is engaged with the bore 42 to prevent wear on the inside surface of the bore 42.

As shown only in FIG. 4, when the retractable supporting means 16 is rotated to its lowered position, a lower portion of the retractable supporting means 45 rotates upward. This lower portion 45 serves the dual purpose of ballasting the retractable supporting means 14 and 16 while it automatically energizes a latching means 28.

Figure 8:
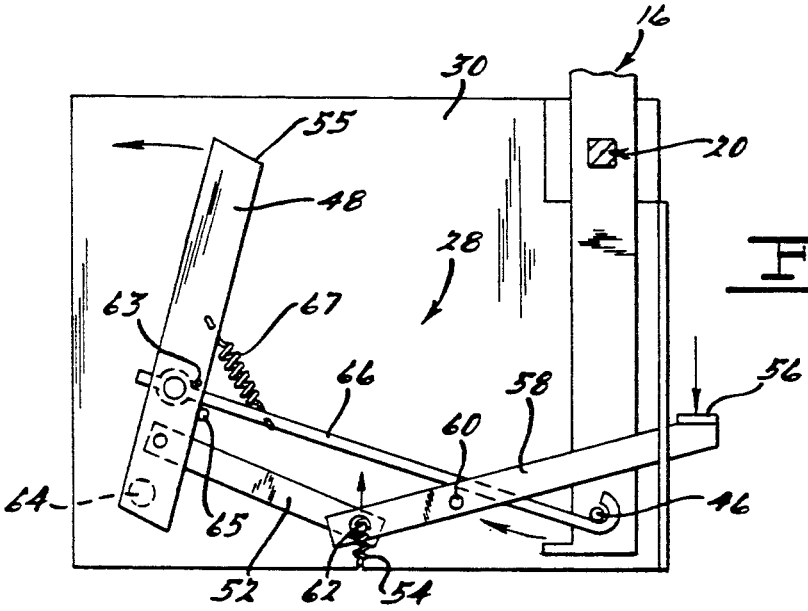
FIGS. 8–11 are diagrammatic representations of the self-energizing latching assembly being actuated as the support frame is lowered and being deactivated, thereby allowing the support frame to be retracted.
Figure 9:
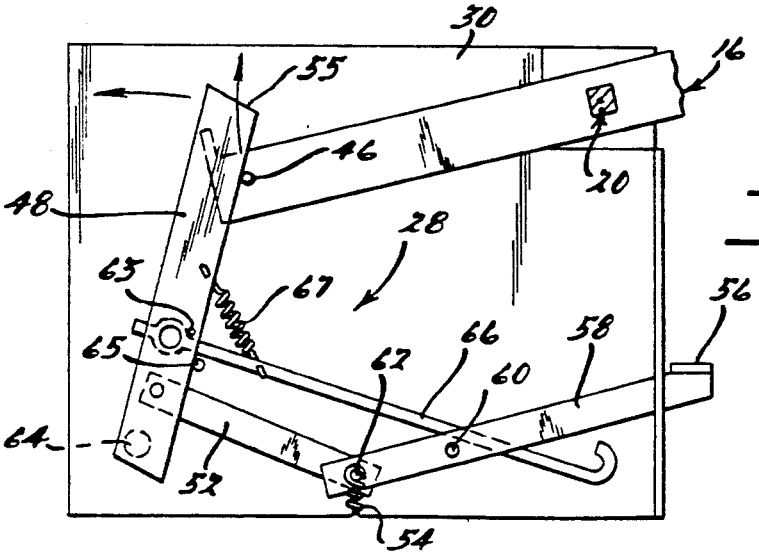

The latching means 28, as embodied in FIGS. 8–11, is a series of bar members pivotally coupled to one another that latch the retractable supporting means 14 and 16 in place. These bar members act in unison as the latching means 28 is activated and deactivated. Activation of the latching means 28 takes place automatically when the retractable supporting means 14 and 16 are lowered. A pin like projection 46 that extends from the lower portion of the retractable supporting means 16 engages with a generally vertical member 48 as the retractable supporting means 14 and 16 are lowered. This is depicted in FIGS. 8 and 9; FIG. 8 shows the retractable supporting means 14 and 16 in a raised position with the latching means 28 unactivated, while FIG. 9 shows the retractable supporting means 14 and 16 being lowered and the pin like projection 46 correspondingly engaging the vertical member 48.

Figure 10:
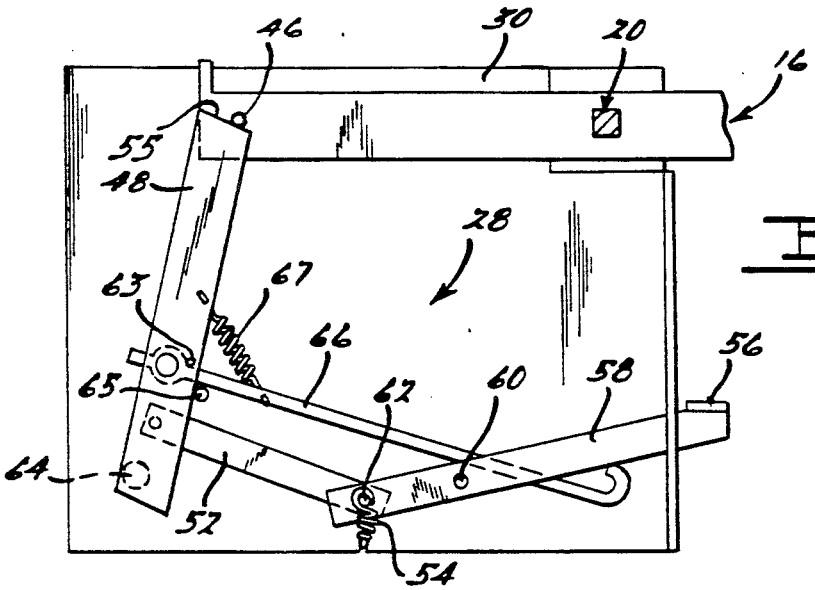

As depicted in FIG. 9, the activation of the latching means 28 forces the vertical member 48 to pivot rearward about a pin 64. As the vertical member 48 pivots rearward, a link member 52, fixed to vertical member 48, and a pivot member 58 follow correspondingly as depicted in FIGS. 8–10. As link member 52 and pivot member 58 follow the motion of vertical member 48, a pin 62 that couples these members together moves generally upward. This pin 62 is attached to a coil spring 54 that is attached to the end plate 30 at its other end. Thus, when the vertical member 48 pivots rearward, and the pin 62 moves generally upward, the spring 54 is tensioned.

As illustrated in FIG. 10, when the retractable supporting means 16 reaches its lowered position, the pin like member 46 becomes higher than the upper surface of the vertical member 48. As a result, tension in the spring 54 pivots the vertical member 48 forward until the pin like member 46 engages with a wedging angle surface 55 on top of the vertical bar member 48. Thus, the lower portion of the retractable supporting means 16 is not permitted to reverse its direction and pivot downward once the pin 46 has engaged. Accordingly, the retractable supporting means 14 and 16 are latched into their lowered position.

Figure 11:
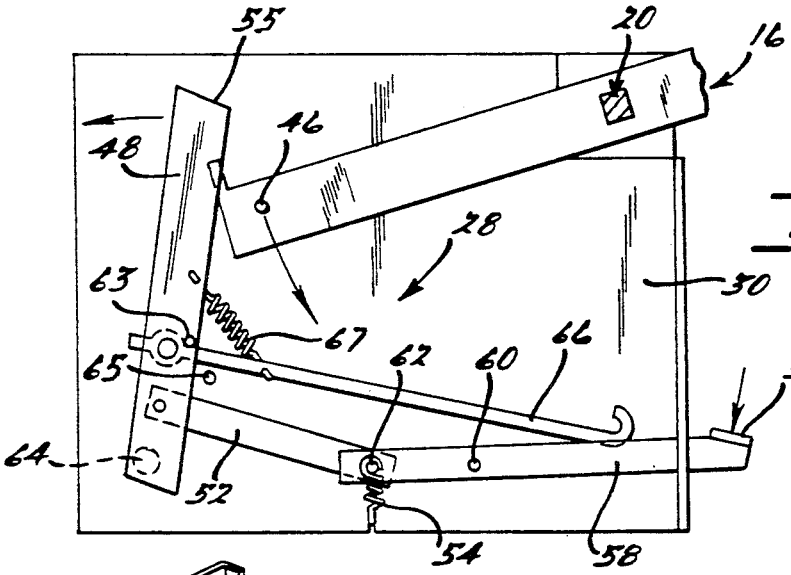

As shown in FIG. 11, to deactivate the latching means 28 and allow the retractable supporting means 16 to be raised, a user can merely depress a foot pedal 56. By depressing the foot pedal 56, the pivot member 58 pivots about a pin 60. The rearward end of pivot member 58 correspondingly pivots upward, forcing a link 52 to translate rearward. In other words the downward movement of the foot pedal 56 is converted into a translational rearward movement of link 52. As a result of this rearward translation, vertical member 48 also pivots rearward causing the pin like member 46 to disengage from the wedging angle surface 55, and allow the retractable supporting means 16 to be raised.

The foot pedal 56 also provides a means for starting the downward travel of the retractable supporting means 16. As shown in FIG. 8, depressing the foot pedal 56 causes the vertical member 48 to pivot rearward about its pin 64. This forces a hook member 66 that is pivotably connected to the vertical member 48 to translate generally rearward. Since the hooked end of hook member 66 is engaged with the pin like member 46, this rearward translation forces the lower end of the retractable supporting means 16 to pivot rearward. Accordingly, depressing the foot pedal 56 initiates the pivoting motion of lowering the retractable supporting means 16 and reduces the initial burden of lowering the furniture components 10(*a*) and 10(*b*). Note that in order for the hook end of the hook member 66 to re-engage with the pin like member 46, two stops 63 and 65, and a spring 67 are used. This also insures proper positioning of the vertical member 48 and the hook member 66.

Figure 12:
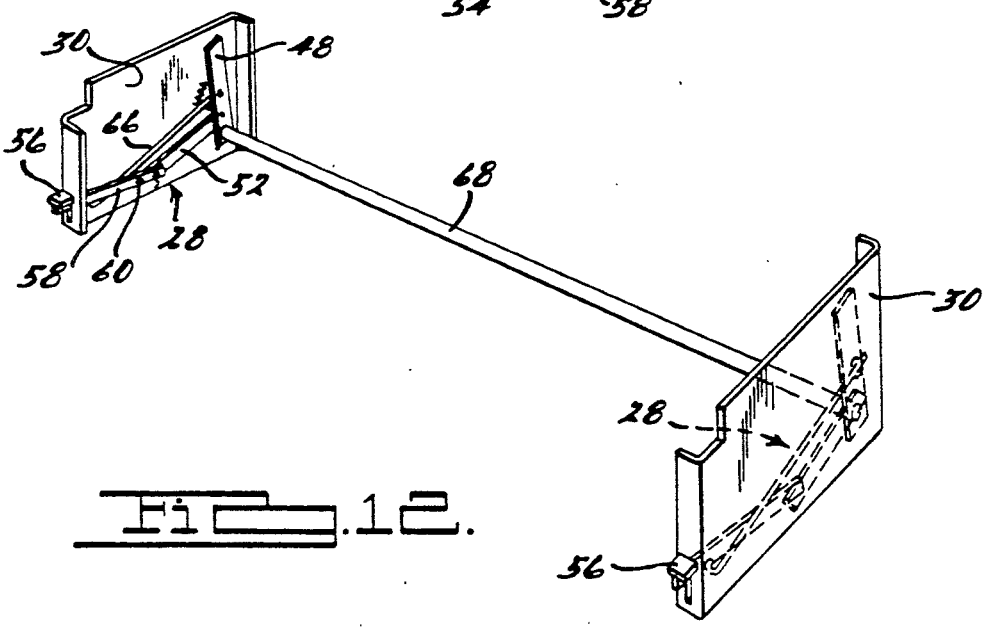
FIG. 12 is a perspective view showing the self-energizing latching means being operable from either side of the base assembly.

FIG. 12 depicts an embodiment where symmetrical latching means 28 are used on both sides of the base assembly 12. A rigid member 68 fixedly attaches the lower portion of both vertical members 48, compelling both latching means 28 to simultaneously activate and deactivate. Moreover, this rigid member 68 allows a user to deactivate the latching means 28 by depressing either foot pedal 56. This embodiment also provides dual latching capability thereby further stabilizing the retractable supporting means 14 and 16.

Figure 13:
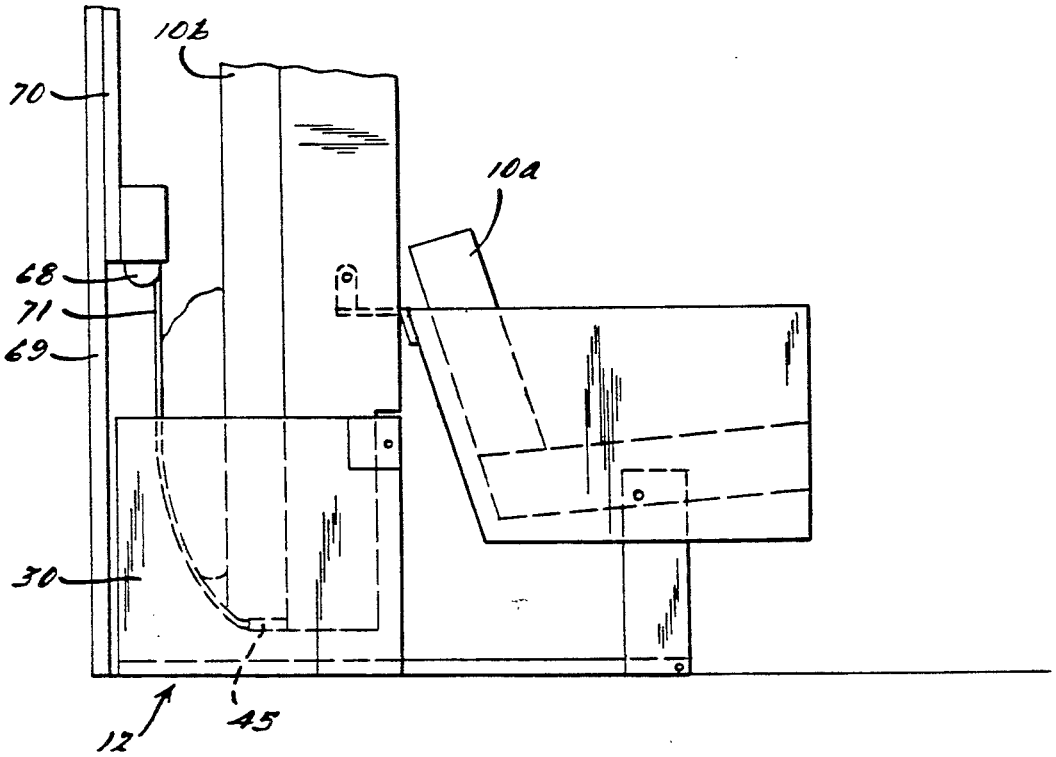
FIG. 13 is a side view showing one embodiment of the retaining means with the bed/sofa convertible furniture in the raised position.
Figure 14:
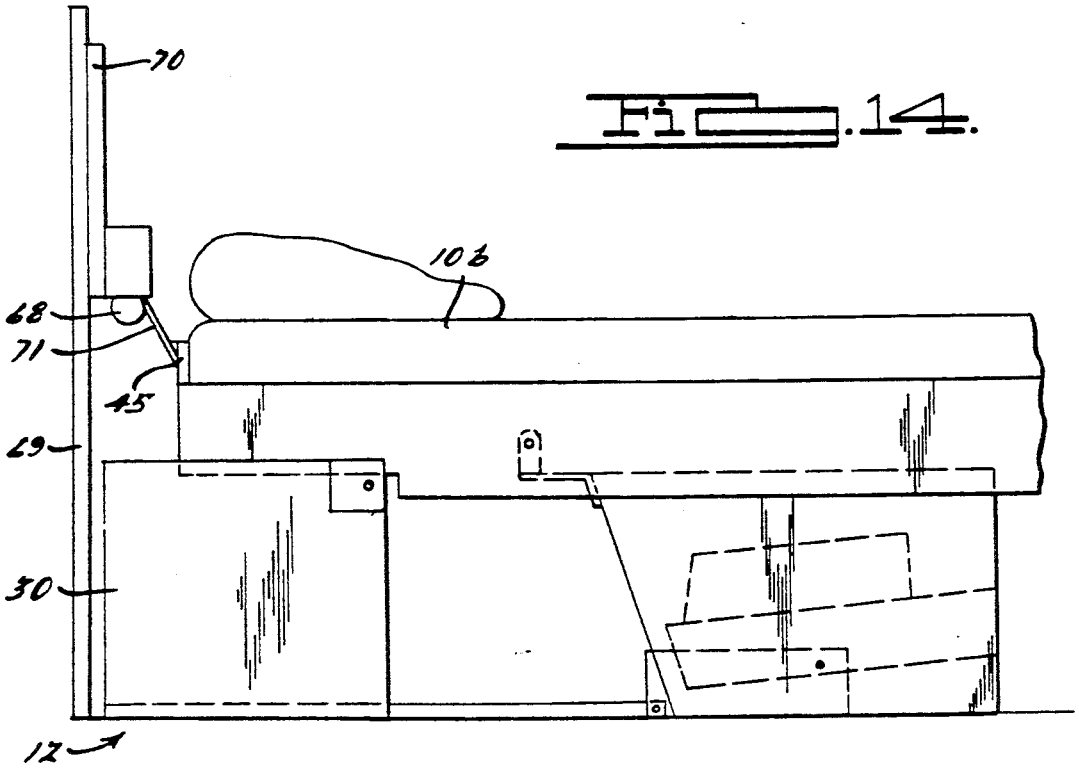
FIG. 14 is a side view showing the same embodiment of the retaining means as in FIG. 13, with the bed/sofa convertible furniture in the lowered position.
Figure 15:
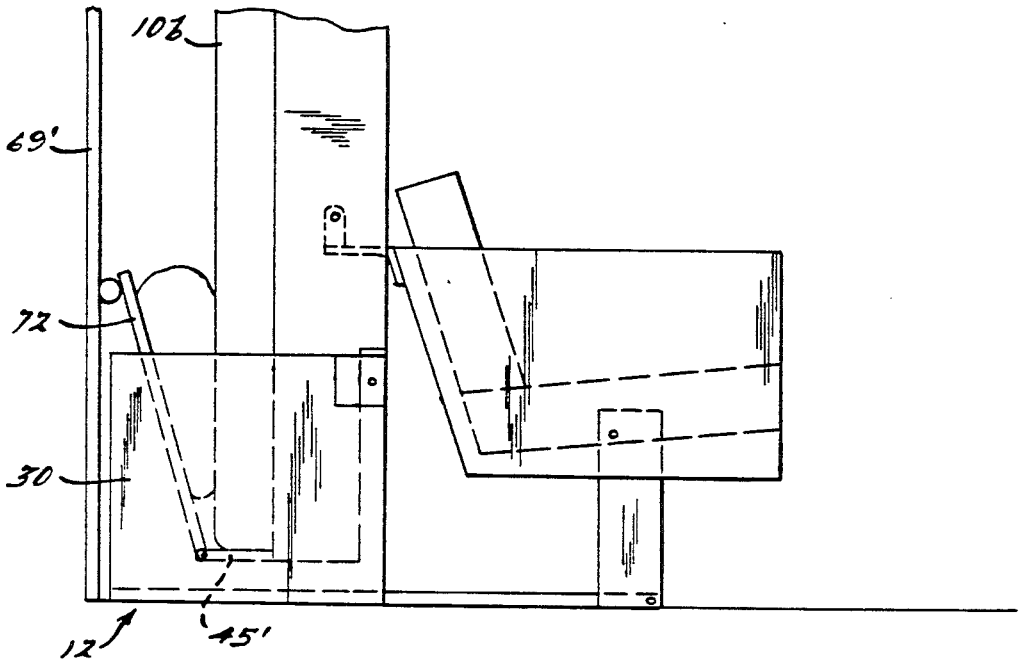
FIG. 15 is a side view showing another embodiment of the retaining means with the bed/sofa convertible furniture in the raised position.
Figure 16:
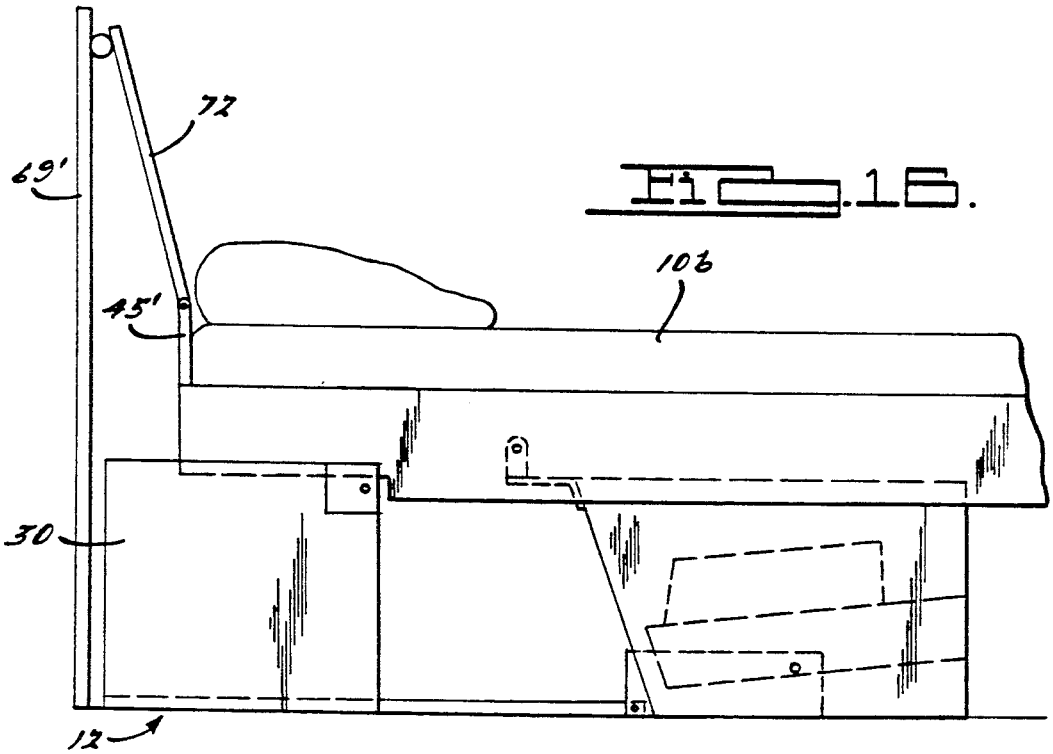
FIG. 16 is a side view showing the same embodiment of the retaining means as in FIG. 15, with the bed/sofa convertible furniture in the lowered position.

Another feature that can be incorporated with the sofa/bed combination is shown in FIGS. 13–16. These FIGURES illustrate the function of a retaining means that prevents loose articles on the furniture components 10*b* from sliding into the base assembly 12 during retraction. FIGS. 13 and 14 show one embodiment of the retaining means, while FIGS. 15 and 16 show an alternate embodiment. Note that both embodiments utilize a structural member 69 that vertically attaches to the rear of the base assembly 12. This structural member 69 serves the dual purpose of supporting a headboard 70 for the furniture components and supporting the retaining means described hereafter.

The embodiment depicted in FIGS. 13 and 14 utilizes a retaining means comprising a pliable sheet of material that is stored on a self winding roller: a typical industrial shade can be utilized. The roller member 68 of this shade is attached to the structural member 69 and its shade portion 71 is attached to the lower portion of the retractable supporting means 45. The roller member 68 is mounted generally higher than the lower portion of the retractable supporting means 45. The width of the industrial shade spans generally from one edge of the retractable supporting means 16 to the other. By utilizing this configuration, the shade unwinds as the retractable supporting means 16 is raised, and rewinds as the retractable supporting means 16 is lowered. Accordingly, as the retractable supporting means 16 is retracted and the furniture components incline, any articles purposely or inadvertently left on the furniture components 10*b*, such as pillows and bedding, or wallets, watches, loose change, etc., are prevented from sliding into the base assembly 12 where they may be difficult to retrieve.

The alternate embodiment shown in FIGS. 15 and 16 illustrates the use of a retaining means that comprises a rigid member 72. In this embodiment, one end of the rigid member 72 is attached to the lower portion of the retractable supporting means 45' by a hinge, while the opposite end of the rigid member 72 is coupled to the structural member 69'. As the retractable supporting means 16 is retracted, the rigid member 72 slidingly engages with the structural member 69'. Accordingly, as depicted in FIG. 16, when the retractable supporting means 16 is in the lowered position, the rigid member 72 projects generally vertically above the upper surface of the furniture components **10*b*. Thus, the rigid member provides a means for preventing loose articles from sliding into the base assembly 12, and further provides a head board for the furniture components 10*b***.

It should be understood that various modifications of the preferred embodiment will become apparent to those skilled in the art after a study of the specification, drawings, and the following claims.

What is claimed is:

1. A convertible furniture frame assembly comprising:

a stationary base assembly;

at least one retractable supporting means coupled to said base assembly for supporting furniture components;

at least one generally horizontal self-standing support means fixedly attached to said base assembly that independently extends from said base assembly for stabilizing said convertible furniture assembly;

at least one two-bar torsion system wherein a first bar extends from said retractable supporting means and a second bar extends from said stationary base assembly generally parallel and adjacent to said first bar with one of said bars having a free end;

at least one clamping means for fixedly attaching said first and second bars to one another;

a self-energizing latching means for automatically latching said retractable supporting means in a lowered position; and a retaining means for holding loose articles on said furniture components as the retractable supporting means is retracted.

2. The convertible furniture frame assembly according to claim 1, wherein said self-standing support means projects outwardly from the base assembly in generally the same direction that the retractable supporting means projects from the base assembly when said retractable supporting means is in the lowered position.

3. The convertible furniture frame assembly according to claim 1, wherein said retractable supporting means lowers to a position generally over the self-standing support means.

4. The convertible furniture frame assembly according to claim 1, wherein said two-bar torsion system extends within said stationary base assembly generally perpendicular to a plane that the retractable support means retracts in.

5. The convertible furniture frame assembly according to claim 1, wherein said clamping means clamps a portion of said first bar to an adjacent portion of said second bar.

6. The convertible furniture frame assembly according to claim 1, wherein said clamping means slidingly engages said bars, thereby allowing said clamping means to be adjustably positioned along said bar for adjusting the torsion of said torsion system.

7. The convertible furniture frame assembly according to claim 1, wherein said self-energizing latching means has a latch that activates automatically when the retractable supporting means is fully lowered by coupling said retractable supporting means to said stationary base assembly.

8. The convertible furniture frame assembly according to claim 1, wherein said self-energizing latching means is deactivated by depressing a foot pedal, thereby allowing said retractable supporting means to be moved into a raised position.

9. The convertible furniture frame assembly according to claim 1, wherein said self-energizing latching means has a means for initiating a lowering motion of said furniture components that is activated by depressing a foot pedal.

10. The convertible furniture frame assembly according to claim 1, wherein said retaining means spans from a lower portion of the retractable supporting means to a generally higher portion of the stationary base assembly.

11. The convertible furniture frame assembly according to claim 1, wherein said retaining means spans laterally, generally from one edge of the retractable supporting means to the other.

12. The convertible furniture frame assembly according to claim 1, wherein said torsion bars within said torsion system utilize a locking assembly for fixedly attaching said first bar to said retractable supporting means, said locking assembly having a two-piece construction that traps said first bar between two members.

13. The convertible furniture frame assembly according to claim 12, wherein said torsion bar locking assembly further has a bore passing through it such that said second bar passes through the bore, thereby allowing said second bar to attach to the base assembly and act as a pivot member for the retractable support as it is raised and lowered.

14. The convertible furniture frame assembly according to claim 13, wherein said bore is fitted with a bushing, thereby allowing the locking assembly to rotate easily and without wearing on the bore.

15. The convertible furniture frame assembly according to claim 13, wherein said second bar passing through said bore and being fixedly attached to the stationary base assembly, indirectly couples the stationary base assembly to the retractable support frame thereby allowing said support frame to pivot about said second bar with respect to the stationary base assembly.

16. The convertible furniture frame assembly according to claim 1, wherein said retaining means in one embodiment comprises an industrial shade that unwinds and rewinds as the furniture components are moved.

17. The convertible furniture frame assembly according to claim 1, wherein said first and second bars cantilever from said stationary base assembly.

18. A convertible furniture frame assembly comprising:

a stationary base assembly;

at least one retractable support frame coupled to said base assembly that supports furniture components;

at least one generally horizontal, self-standing outrigger, fixedly attached to said base assembly that extends from said base assembly for stabilizing said convertible furniture assembly;

at least one two-bar torsion system wherein a first bar extends from said retractable supporting frame and a second bar extends from said stationary base assembly generally parallel and adjacent to said first bar with one of said bars having a free end;

at least one adjustable clamp for fixedly clamping portions of said first and second bars to one another; and a self-energizing latch that automatically latches the retractable support frame to the base assembly when said retractable support frame reaches a lowered position.

19. The convertible furniture frame assembly according to claim 18, wherein said self-standing outriggers project from the base assembly in generally the same direction that the retractable support frame projects from said base assembly when said retractable support frame is in the lowered position.

20. The convertible furniture frame assembly according to claim 18, wherein said retractable support frame lowers to a position generally over said at least one, generally horizontal self-standing outrigger.

21. The convertible furniture frame assembly according to claim 18, wherein said convertible furniture utilizes two of said two-bar torsion systems.

22. The convertible furniture frame assembly according to claim 18, wherein said two-bar torsion system extends within said stationary base assembly generally perpendicular to a plane that the retractable support frame rotates in.

23. The convertible furniture frame assembly according to claim 18, wherein said two bar torsion system cantilevers only across a portion of said stationary base assembly.

24. The convertible furniture frame assembly according to claim 18, wherein said clamp fixedly clamps a portion of said first bar to an adjacent portion of said second bar.

25. The convertible furniture frame assembly according to claim 18, wherein said clamp slidingly engages said bars to permit the clamping of any two adjacent portions of said bars, thereby allowing said two-bar torsion system to be adjustable and capable of storing a predetermined amount of energy in said bars.

26. The convertible furniture frame assembly according to claim 18, wherein said self-energizing latch is activated automatically when the retractable support frame is fully lowered by coupling said retractable support frame to said stationary base assembly.

27. The convertible furniture frame assembly according to claim 26, wherein said self-energizing latch couples the retractable support frame in its lowered position to said stationary base assembly by engaging a pin like means on the retractable support frame with a wedging angle surface.

28. The convertible furniture frame assembly according to claim 18, wherein said self-energizing latch is deactivated by depressing a foot pedal, thereby allowing said retractable support frame to be moved into a raised position.

29. A convertible furniture frame assembly comprising:

a free standing stationary base assembly;

retractable supporting means coupled to said base assembly for supporting furniture components, said supporting means being retractable between raised and lowered positions with a portion of said supporting means cantilevering from said base assembly;

generally horizontal self-standing support means fixedly attached to said base assembly, said self-standing support means extending from said base assembly for stabilizing said convertible assembly; and at least one extension member coupled between said self-standing support means and said retractable supporting means such that as said retractable supporting means is lowered said extension member extends the effective length of said self-standing support means.

30. The convertible furniture frame assembly according to claim 29, wherein said self-standing support means projects outwardly from the base assembly in generally the same direction that the retractable supporting means projects from the base assembly when said retractable supporting means is in a lowered position.

31. The convertible furniture frame assembly according to claim 29, wherein said retractable supporting means lowers to a position generally over the self-standing support means.

32. A convertible furniture frame assembly comprising:

a stationary base assembly;

at least one retractable supporting means coupled to said base assembly for supporting furniture components;

at least one two-bar torsion system wherein a first bar extends from said retractable supporting means and a second bar extends from said stationary base assembly generally parallel and adjacent to said first bar with one of said bars having a free end; and at least one clamping means for fixedly attaching said first and second bars to one another.

33. The convertible furniture frame assembly according to claim 32, wherein said two-bar torsion system extends within said stationary base assembly generally perpendicular to a plane that the retractable support means retracts in.

34. The convertible furniture frame assembly according to claim 32, wherein said clamping means clamps a portion of said first bar to an adjacent portion of said second bar.

35. The convertible furniture frame assembly according to claim 32, wherein said clamping means slidingly engages said bars, thereby allowing said clamping means to be adjustably positioned along said bars for adjusting the torsion of said torsion system.

36. The convertible furniture frame assembly according to claim 32, wherein said first and second bars cantilever from said stationary base assembly.

37. A convertible furniture frame assembly comprising:

a stationary base assembly;

at least one retractable supporting means coupled to said base assembly for supporting furniture components;

a self-energizing latching means for automatically latching said retractable supporting means in its lowered position; and a foot pedal for deactivating said self-energizing latching means thereby allowing said retractable supporting means to be moved into a raised position.

38. The convertible furniture frame assembly according to claim 37, wherein said self-energizing latching means has a latch that activates automatically when the retractable supporting means is fully lowered by coupling said retractable supporting means to said stationary base assembly.

39. The convertible furniture frame assembly according to claim 37, wherein said self-energizing latching means has a means for initiating the lowering motion of said furniture components that is activated by depressing a foot pedal.

40. A convertible furniture frame assembly comprising:

a stationary base assembly;

at least one retractable supporting means coupled to said base assembly for supporting furniture components; and a collapsible retaining means made of a pliable material, for holding loose articles on said furniture components, that retracts and is stored on a roller as the retractable supporting means is retracted.

41. The convertible furniture frame assembly according to claim 40, wherein said collapsible retaining means spans from a lower portion of the retractable supporting means to a generally higher portion of the stationary base assembly.

42. The convertible furniture frame assembly according to claim 40, wherein said collapsible retaining means spans laterally, generally from one edge of the retractable supporting means to the other.

43. The convertible furniture frame assembly according to claim 40, wherein said collapsible retaining means is an industrial shade.

44. The convertible furniture frame assembly according to claim 40, wherein said collapsible retaining means further acts as a head board.

45. A convertible furniture frame assembly comprising:

a stationary base assembly;

at least one retractable supporting means coupled to said base assembly for supporting furniture components;

at least one two-bar torsion system wherein a first bar extends from said retractable supporting means and a second bar extends from said stationary base assembly generally parallel and adjacent to said first bar with one of said bars having a free end;

at least one clamping means for fixedly attaching said first and second bars to one another; and a retaining means for holding loose articles on said furniture components as the retractable supporting means is retracted.

46. The convertible furniture frame assembly according to claim 45, wherein said two-bar torsion system extends within said stationary base assembly generally perpendicular to a plane that the retractable support means retracts in.

47. The convertible furniture frame assembly according to claim 45, wherein said first and second bars cantilever from said stationary base assembly.

48. The convertible furniture frame assembly according to claim 45, wherein said clamping means clamps a portion of said first bar to an adjacent portion of said second bar.

49. The convertible furniture frame assembly according to claim 45, wherein said clamping means slidingly engages said bars, thereby allowing said clamping means to be adjustably positioned along said bars for adjusting the torsion of said torsion system.

50. The convertible furniture frame assembly according to claim 45, wherein said retaining means spans from a lower portion of the retractable supporting means to a generally higher portion of the stationary base assembly.

51. The convertible furniture frame assembly according to claim 45, wherein said retaining means spans laterally, generally from one edge of the retractable supporting means to the other.

52. The convertible furniture frame assembly according to claim 45, wherein said retaining means further acts as a head board.

53. The convertible furniture frame assembly according to claim 45, wherein said retaining means is an industrial shade.

* * * * *

UNITED STATES PATENT AND TRADEMARK OFFICE

CERTIFICATE OF CORRECTION

PATENT NO. : 5,136,737

DATED : August 11, 1992

INVENTOR(S) : George S. Reppas et al

It is certified that error appears in the above-identified patent and that said Letters Patent is hereby corrected as shown below:

On the title page, under "U.S. Patent Documents", reference 3,597,568, delete -- "3,597,568 7/1976 Drexhage" --.

Column 4, line 26, "utilized 26" should be -- 26 utilized --.

Column 6, line 50, ":" should be -- ; --.

Column 7, line 67, "bar" should be -- bars --.

Signed and Sealed this

Fourth Day of January, 1994

*Attest:*

*Attesting Officer*

BRUCE LEHMAN

*Commissioner of Patents and Trademarks*